US005505108A

United States Patent [19]

Kuchta et al.

[11] Patent Number: 5,505,108

[45] Date of Patent: Apr. 9, 1996

[54] CUTTING KNIFE AND SHARPENER FOR AUTOMATIC MACHINES FOR CUTTING CLOTH AND SIMILAR SHEET MATERIALS

[75] Inventors: Richard Kuchta, Tolland; Donald C. Button, Cheshire, both of Conn.

[73] Assignee: Gerber Garment Technology, Inc., Tolland, Conn.

[21] Appl. No.: 123,282

[22] Filed: Sep. 17, 1993

[51] Int. Cl.[6] ..... B26D 7/12

[52] U.S. Cl. ..... 83/174; 83/697; 83/747; 83/940; 451/420

[58] Field of Search ..... 83/174, 174.1, 83/697, 747, 940; 30/350; 451/419, 420, 428, 254, 45

[56] References Cited

U.S. PATENT DOCUMENTS

| | | | |
|---|---|---|---|
| 1,291,381 | 1/1919 | Blumenthal | 451/420 |
| 2,295,654 | 9/1942 | Gury, Jr. | 451/419 X |
| 4,574,673 | 3/1986 | Pearl | 83/697 |
| 4,653,373 | 3/1987 | Gerber | 83/174 X |

FOREIGN PATENT DOCUMENTS

| | | | |
|---|---|---|---|
| 2921695 | 12/1980 | Germany | 83/697 |

*Primary Examiner*—Eugenia Jones
*Attorney, Agent, or Firm*—McCormick, Paulding & Huber

[57] ABSTRACT

In an automated machine for cutting cloth or fabric and similar sheet materials the knife is made from a high-alloy tool steel to provide the knife with a sharp cutting edge capable under a given set of conditions to cut sheet material for a far longer period of time before requiring re-sharpening than the case with the knives previously used in such machines. A sharpener is also provided which allows the knife after becoming dull to be returned to a sharp condition while removing only a minimum amount of the knife material, thereby further increasing the service life of the knife.

2 Claims, 5 Drawing Sheets

CUTTING KNIFE AND SHARPENER FOR AUTOMATIC MACHINES FOR CUTTING CLOTH AND SIMILAR SHEET MATERIALS

FIELD OF THE INVENTION

The invention relates to automatically controlled machines for cutting cloth or fabric and similar limp sheet materials such as paper and plastics; and deals more particularly with an improved cutting knife for use as the cutting tool of such machine which knife is made from a material different from those previously used for such knives, with a sharpener for use in sharpening the improved knives, and with a related sharpening method.

BACKGROUND OF THE INVENTION

Automated cutting machines are well known for use in cutting from webs of cloth and other sheet material pieces used in the manufacture of clothing, upholstery and the like, the pieces usually being subsequently joined by sewing or other seaming processes to other pieces or components to complete a finished article of clothing or other product. Typical examples of such cutting machines are shown by U.S. Pat. Nos. 3,495,492, 3,955,458, 4,643,061, 4,646,911 and 4,841,822.

In such machines the sheet material to be cut is spread on a supporting surface, either as a single layer or as a layup of multiple layers, and is cut by a powered cutting knife driven in a cutting motion relative to the supporting surface and also moved along desired lines of cut relative to the supporting surface by a positioning system controlled by an associated controller responsive to cutting instructions input to the controller from a record medium such as a magnetic tape or disc or from some other data source. The cutting knife may be a circular one having a circular cutting edge and which for its cutting motion is rotated about its central axis, but more usually it is one elongated along a longitudinal axis, arranged generally perpendicularly to the supporting surface, having a sharp cutting edge extending along a longitudinal portion thereof, and which for its cutting motion is reciprocated along its longitudinal axis. The reciprocating knife, during its cutting operation, extends through the material being cut and with its lower end passes beyond the bottom surface of the work material and penetrates into the material forming the supporting surface or into some suitable receiver. To allow for such penetration, the supporting surface may, for example, be made as a bed of vertically extending bristles, and at the same time the bristle bed may be used as part of a vacuum system for applying a vacuum to the bottom surface of the material to be cut to aid in holding it to the supporting surface and in compacting it into a better condition for cutting; and in the latter case a sheet of air impermeable material may be spread over the work material to enhance the compressing effect achieved by the vacuum.

It is well known that in the use of automatic cutting machines of the aforementioned type the cutting knives become dull after relatively short periods of use and must frequently be sharpened to maintain acceptable cutting performance. The frequency of required sharpenings depends on the composition and height of the material being cut, as well as on other factors, but in an exemplary case the knife may have to be sharpened at about every thirty inches of cut. During each sharpening procedure the cutting operation is stopped, and the procedure lasts for at least several seconds until cutting is resumed. Accordingly, the frequent sharpenings substantially prolong the time required for cutting a given marker or set of patterns from the sheet material. Also, the sharpening is usually performed by grinding processes which during each sharpening procedure remove a substantial amount of the knife material thereby shortening the service life of the knife.

The general object of the invention is therefore to provide a knife for use in an automatically controlled machine for cutting cloth and the like which knife retains an acceptably sharp cutting edge longer and requires sharpenings much less frequently than the blades heretofore used in such machines.

A further object of the invention is to provide a knife of the afore-described type in combination with an associated sharpener and sharpening method whereby the cutting edge of the knife may be restored to acceptable sharpness after having become dulled despite the hard and tough nature of the blade material and without removing an excessive amount of such material, thereby allowing the knife to have a very much longer service life than the knives previously used with automatic cloth cutting machines.

Other objects and advantages of the invention will be apparent from the following description of the preferred embodiments of the invention and from the accompanying drawings and claims.

SUMMARY OF THE INVENTION

The invention resides in a knife for use in an automatically controlled machine for cutting cloth and similar sheet materials, which knife is made from a material heretofore not used for such knives but which has been discovered by Applicants to result in a knife having the characteristic of maintaining a satisfactorily sharp cutting edge throughout a period of cutting operation very much longer than the case with knives previously customarily used, the knife of the invention therefore requiring sharpenings on a much less frequent basis than such previous knives and, in conjunction with a sharpener and sharpening method also forming part of the invention, having a very much longer service life than previous knives of similar construction.

More particularly, the invention resides in the involved knife being made from a relatively hard and tough high-alloy, "high-speed" or "tool", steel of the type often used in the construction of metal cutting and metal working tools, with that steel having an HRC hardness of between 55 to 64, and optimally between 60 and 62, and a fine grain size, preferably an S-G grain size of between 13 to 18.

More particularly the invention resides in the knife steel being one having at least 20% of its weight made up of alloying elements selected from the group of elements made up of carbon, molybdenum, vanadium, manganese, tungsten, silicon and chromium; known commercially available ones of such steels being CPM 10V, ASP 30, ASP 53, ASP 60 and M42.

The invention also resides in a sharpener for use with the aforementioned knife for bringing the cutting edge of the knife back to a sharpened condition after it has been dulled by use, the sharpener and sharpening method using a rotatably driven sharpening unit having a flexible grit carrying member supported on a resilient backup member, the sharpening being accomplished by bringing the grit carrying member into contact with the knife while the knife is reciprocated, in the case of an elongated reciprocating knife, or rotated, in the case of a circular knife, the abrasive grit being of such a particle size so as to have, in combination with the resilient support of its flexible carrying member, the effect of honing or polishing the knife to a sharp condition rather than the effect of grinding it.

The invention also resides in further details of the knife, the sharpener and the sharpening method as described in the following detailed description of the preferred embodiments and in the accompanying claims and drawings.

DESCRIPTION OF THE PREFERRED EMBODIMENTS

Figure 1:
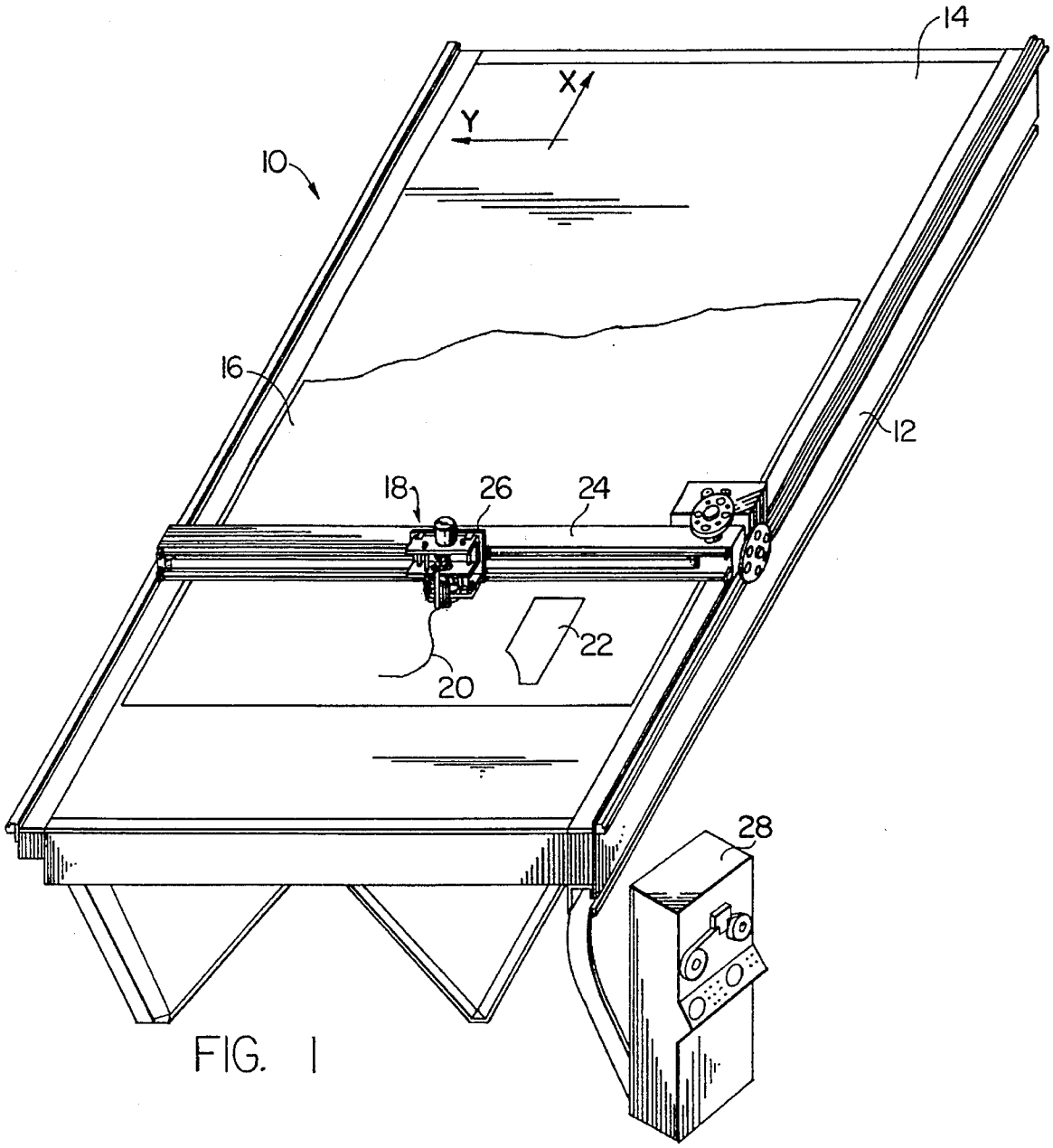
FIG. 1 is a perspective view of an automated cloth cutting machine with which a knife, sharpener and sharpening method embodying the invention are used.

Turning to the drawings, FIG. 1 shows a cloth cutting machine of the type with which the invention may be used. This machine is, except for its knife and sharpener mechanism, essentially similar to the one shown by U.S. Pat. No. 4,841,822 to which reference may be made for further details of its construction and operation. For the present purposes it is sufficient to note that the machine, indicated generally at 10, includes a stationary table 12 providing an upwardly facing horizontal supporting surface 14 for supporting, in spread condition, cloth or other sheet material to be cut. In the illustrated case the sheet material to be cut consists of a single layer of material 16. However, the sheet material may also, if desired comprise a layup of sheets spread on top of one another.

Cutting of the sheet material 16 is performed by a cutting head 18 movable in the illustrated X and Y coordinate directions over the supporting surface 14 to cut the material 16 along lines of cut, such as illustrated at 20, having components extending in both the X and Y directions. In most instances the cutting is performed so that the cutting head 18 cuts pattern pieces having closed shapes from the sheet material 16, which pieces are later assembled with one another or with other components by sewing or other seaming processes to form finished articles of clothing, upholstery or the like, one such pattern piece being shown and indicated at 22.

For movement in the X coordinate direction the cutting head 18 is carried by and moves with a main carriage 24 extending over the supporting surface 14 and movable in the X coordinate direction relative to the table; and for movement in the Y coordinate direction the cutting head 18 is supported on a work carriage 26 movable along the length of the main carriage 24 in the Y coordinate direction. Suitable commands resulting in coordinated movements of the cutting head 18 in the X and Y coordinate directions, and other commands required for the automatic operation of the cutting head 18, are supplied by a controller 28.

The support surface 14 of the table 12 may be one which is penetrable by the cutting knife of the cutting head 18, and if so the surface 14 may be provided by a bed of vertically extending bristles as disclosed in U.S. Pat. No. 4,481,822. If desired, the means providing the supporting surface 14 may also be connectable with a vacuum system for applying vacuum to either the entire surface or to selected portions thereof to aid in holding the work material 16 to the supporting surface and in compressing it into a more easily cuttable condition. Further, as is well known, if such a vacuum system is used the work material may also be covered with an air impermeable sheet to enhance the compressing effect of the vacuum on the work material.

Figure 2:
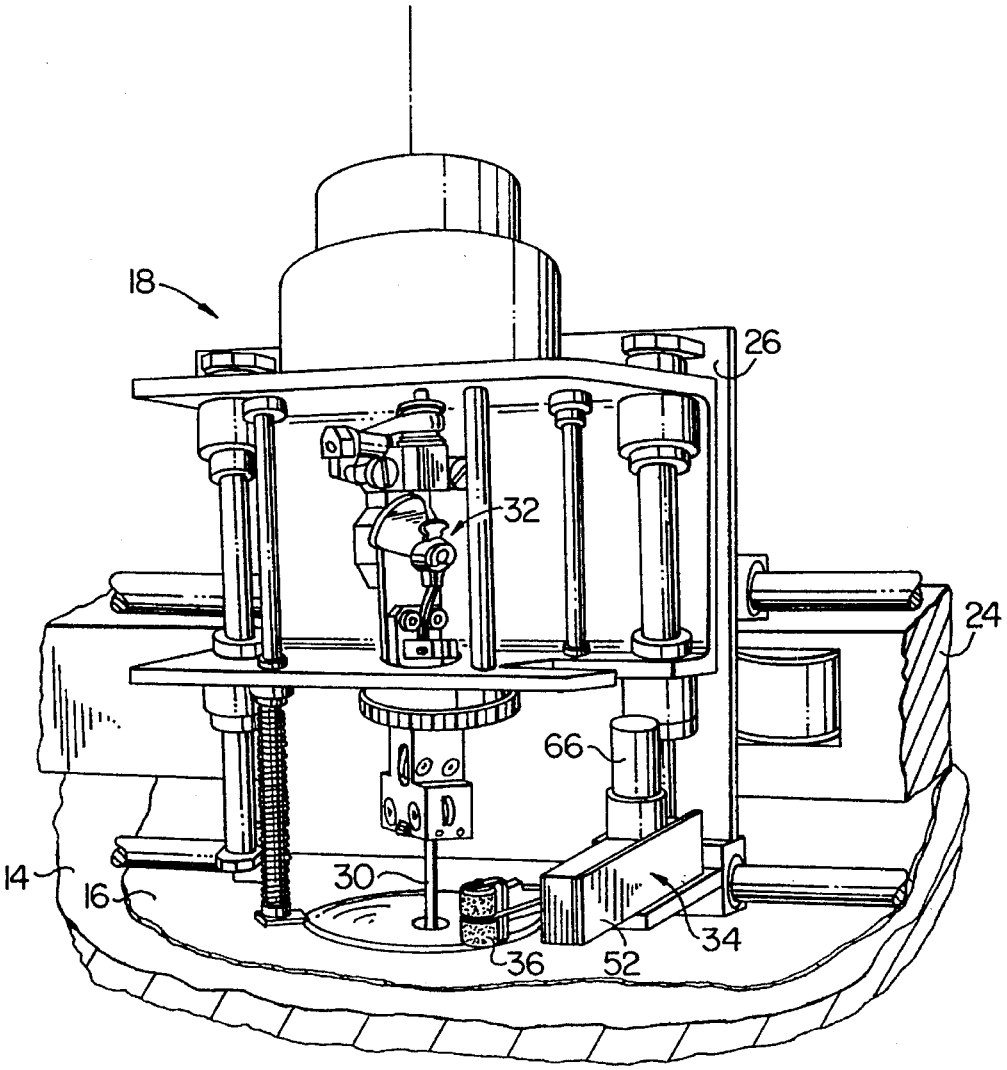
FIG. 2 is a perspective view of the cutting head of the machine of FIG. 1.

FIG. 2 shows the cutting head 18 of FIG. 1 in an enlarged view. As seen, this head 18 includes a cutting tool in the form of an elongated knife 30, oriented with its longitudinal axis generally perpendicular to the supporting surface 14, which for its cutting motion is reciprocated along its longitudinal axis by an eccentric drive mechanism indicated generally at 32. Associated with the knife 30 and carried by the work carriage 26 is a knife sharpener mechanism, indicated generally at 34, having a rotatably driven sharpening unit 36. Again, except for the construction of the knife 30 and of the sharpener mechanism 34, the cutter head 18 is or may be essentially similar to the one shown in U.S. Pat. No. 4,841,822, and reference may be had to said patent for a better understanding of its details.

The shape and dimensions of the knife 30 may vary widely without the parting from the invention. However, in the illustrated case it is shown to be of substantially the same shape as that of U.S. Pat. No. 4,841,822.

Figure 4:
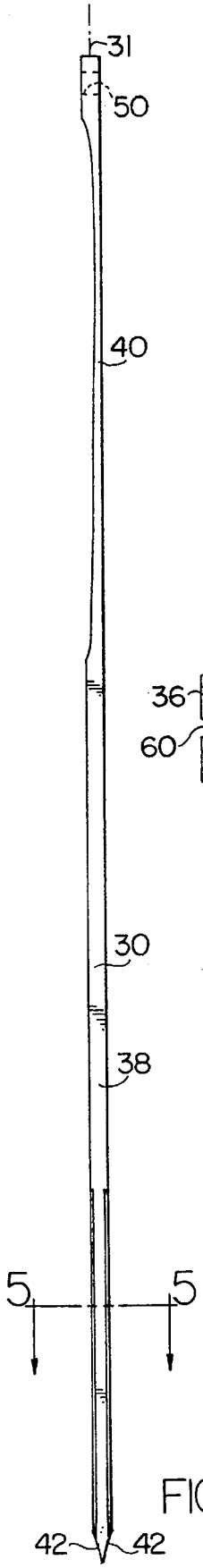
FIG. 4 is a front view of the knife of FIG. 3.

As shown, the knife 30 is an elongated member having and extending along a longitudinal axis 31 and having a lower portion 38 and an upper portion 40. At the very lower end of the lower portion 38 are two inclined faces 42 which meet to define an inclined generally downwardly facing sharp edge 44. Further, on the two sides of the lower portion 38 are two concave inclined surfaces 46 which meet to define the main cutting edge 48 of the knife which extends along a straight line essentially perpendicular to the longitudinal axis 31 for a substantial distance upwardly from the downwardly facing edge 44. The upper portion 40 of the knife includes an opening 50 for connecting the knife to the eccentric drive mechanism 32, and a part of the upper portion 40 is of reduced thickness, as seen in FIG. 4, to enhance the flexibility of the knife which allows its upper end, as seen in FIG. 4, to flex to the right and left of the position illustrated to accommodate the horizontal movement required by the eccentric drive.

Figure 3:
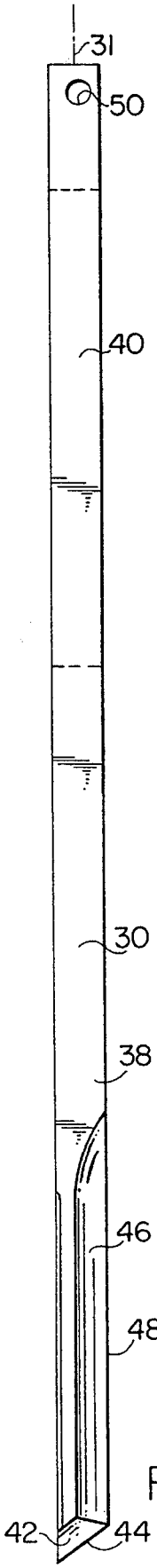
FIG. 3 is a side view of the knife used in the cutting head of FIG. 2.
Figure 5:
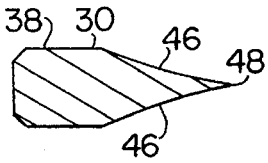
FIG. 5 is an enlarged sectional view taken on the line 5—5 of FIG. 4.

In keeping with the invention, at least that portion of the knife which is located in the vicinity of and which defines the cutting edge 48 is made of a high-alloy tool steel such as not heretofore used in the construction of such knives and which, as has been discovered by Applicants, gives improved service characteristics to the knife. Preferably, however, and as shown in FIGS. 3, 4 and 5 the entire knife 30 is a one piece member made entirely of the tool steel in question.

The tool steel of which the knife 30 is made is one sometimes referred to as a "high-alloy" or "high-speed" steel, at least 20% of the weight of which is made up of alloying elements (that is, elements in addition to the iron which makes up the major portion of the steel) providing the steel with relatively high hardness and toughness characteristics. These alloying elements are selected from the class consisting of carbon, vanadium, cobalt, manganese, molybdenum, chromium, tungsten, and silicon. By controlled heat treatment of these steels the hardness and toughness characteristics, as well as inherently the grain size, of them may be varied.

Further, in keeping with the invention the steel used for the knife is so heat treated that the finished knife has an HRC hardness of between 55 to 64, and more preferably between 60 to 62, and has an S-G grain size of between 13 to 18.

Known commercially available steels suitable for making the knives of this invention are identified as M42 steel, CPM 10V, ASP 30 steel, ASP 53 steel, ASP 60 steel. The analyses of these steels given in weight percentages are:

| M42 Steel | | | | | | |
|---|---|---|---|---|---|---|
| C | Si | W | Cr | V | Mo | Co |
| 1.08 | 0.50 | 1.50 | 3.85 | 1.20 | 9.50 | 8.00 |
| | | | Total = 25.63% | | | |
| **CPM 10V Steel** | | | | | | |
| C | Mn | Si | Cr | V | Mo | S |
| 2.45 | 0.50 | 0.90 | 5.25 | 9.75 | 1.30 | 0.07 |
| | | | Total = 20.22% | | | |
| **ASP 30 Steel** | | | | | | |
| C | Cr | Mo | W | V | Co | |
| 1.28 | 4.2 | 5.0 | 6.4 | 3.1 | 8.5 | |
| | | | Total = 28.48% | | | |
| **ASP 53 Steel** | | | | | | |
| C | Cr | Mo | W | V | | |
| 2.5 | 4.0 | 3.0 | 4.0 | 8.0 | | |
| | | | Total = 21.5% | | | |
| **ASP 60 Steel** | | | | | | |
| C | Cr | Mo | W | Co | V | |
| 2.30 | 4.2 | 7.0 | 6.5 | 10.5 | 6.5 | |
| | | | Total = 37% | | | |

The blade 30, and other blades made of the high-alloy tool steel of this invention, have been found to be difficult to sharpen with the bonded ceramic grinding wheels and other devices used in the past for sharpening the blades of automated cloth cutting machines. As part of the invention, Applicants have unexpectedly discovered that by using a different type of sharpener mechanism and sharpening method from those used in the past, the knife 30, and other knives using the high-alloy tool steel of the invention, may be satisfactorily brought back to a sharp condition from a dull condition, and have further found that such sharpener mechanism and method tend to produce a honing or polishing effect on the blade as opposed to a grinding effect, the sharpening therefore removing a minimum amount of the blade material during each sharpening cycle, thereby increasing the service life of the blade.

Figure 7:
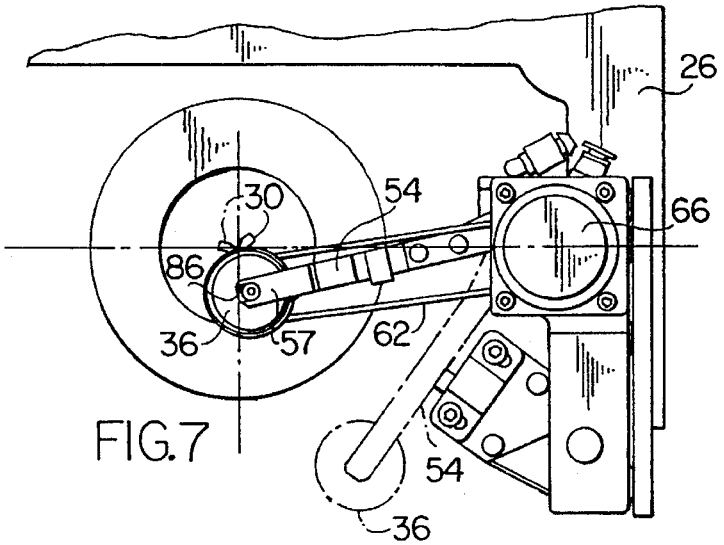
FIG. 7 is a top view of the sharpener of FIG. 6 showing the sharpening unit thereof in both its retracted and operating positions.
Figure 6:
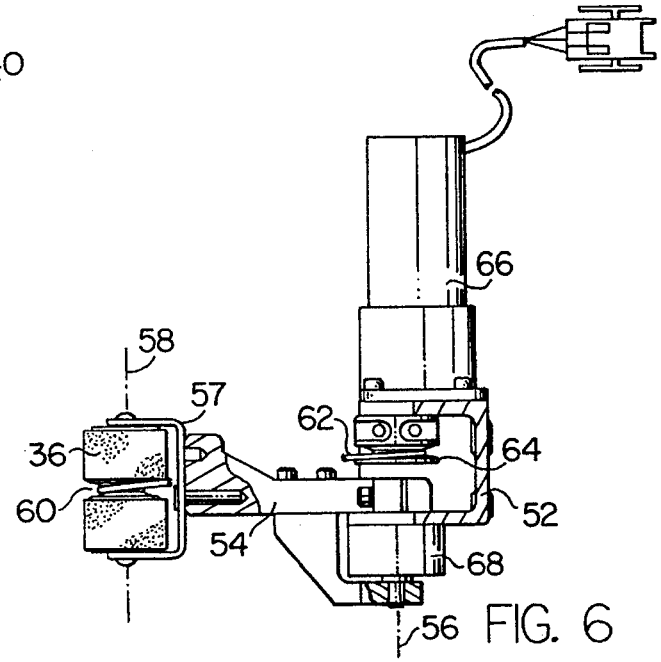
FIG. 6 is a side view, partly in elevation and partly in section of the sharpener mechanism included in the cutting head of FIG. 2.
Figure 8:
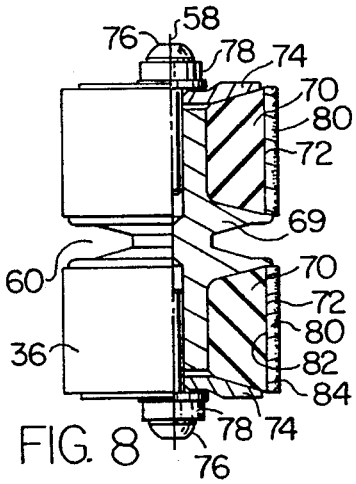
FIG. 8 is an enlarged view partly in elevation and partly in section of the sharpening unit of the sharpener mechanism of FIG. 6.

Referring to FIGS. 6, 7 and 8 the sharpener mechanism includes a frame 52 fixed to the work carriage 26 and supporting an arm 54 movable about a vertical axis 56. On the outer end of the arm 54 is the sharpening unit 36 carried by a bracket 57 fastened to the arm 54 and rotatable about a vertical axis 58. The sharpening unit 36 is generally cylindrical in shape and has a middle groove 60 receiving a drive belt 62 passing over a drive pulley 64 driven by a motor 66 mounted on the frame 52.

The arm 54 of the sharpening mechanism is movable about its vertical rotational axis 56 by a rotary actuator 68 and, as best seen in FIG. 7, is movable between a retracted position, shown by the broken lines of FIG. 7, and a sharpening position shown by the full lines of FIG. 7. In the retracted position the sharpening unit 36 is spaced from the blade 30, and when a sharpening of the blade is required the arm 54 is moved to the illustrated full line position at which the sharpening unit 36 engages one or the other of the faces 46 of the blade 30. As indicated in FIG. 4 the blade 30 is rotatable about an axis colinear with, or substantially colinear with, its longitudinal axis 31 so that either one of its faces 46 may be brought into contact with the sharpening unit 36. The matter of which face or faces 46 the sharpening unit contacts during a given sharpening cycle may vary without departing from the invention. For example, in one case the sharpening unit may engage only one face 46 during a sharpening cycle and that face may be the same one of the two faces 46 throughout all successive sharpening cycles. In another case, throughout each sharpening cycle the sharpening unit may first engage one of the faces 46 and then in a later portion of the same cycle may engage the other face 46. In another case, the sharpener unit may engage only one face 46 throughout a given sharpening cycle but that face will be the one alternate to the one engaged in the immediately previous sharpening cycle. In any event, throughout a given sharpening cycle as the sharpener unit 36 engages the associated face 46 of the blade 30 the sharpening unit 36 is rotated about its vertical axis 58 and the knife is reciprocated in its cutting motion along its longitudinal axis 31 by the eccentric drive mechanism 32 while the knife is held in a raised condition out of cutting engagement with the sheet material 16.

As seen in FIG. 8 the sharpening unit 36 is made up of a generally cylindrical base member 69 made of metal or other rigid material and carrying two annular resilient backup members 70 each having an outer cylindrical face 72. At each end of the unit is an annular end plate 74 received on a screw 76 threaded into the base member 69. The screws 76 are colinear with the rotational axis 58 and each also carries a ball bearing unit 78. The head of each screw 76 bears on the inner race of its associated bearing unit 78 and that inner race also bears on the associated end plate 74. Therefore, by threading the screws 76 into and out of the base member 69 the compression of the backup members 70 may be varied to slightly vary the diameters of their outer faces 72. Received on each backup member 70 is a flexible grit carrier member 80.

Each grit carrier member 80 is in the form of a flexible annular sleeve made up of a flexible band of paper or fabric or the like and having an inner face 82 engaging the outer face 72 of the associated backup member 70 and an outer face 84 carrying particles of abrasive grit which may be attached to the outer face 84 by adhesive or other means. Preferably, the particles of abrasive grit are made of ceramic aluminum oxide and preferably these particles are approximately of grit size 80. As a result of the flexible nature of the grit carrier members 80 and the resilient nature of the backup members 70, during a sharpening procedure the grit carrier members can yield in the direction perpendicular to their outer faces 84 and in the direction toward the resilient backup members 70.

By loosening and tightening the screws 76 the grit carrier members 80 may be loosened from and tightened onto the backup members 70 to allow their easy replacement by new ones of such members after they have become worn. The bracket 57 engages the outer races of the bearings 78 to rotatably support the unit 36, and as seen in FIG. 7 the outer ends of the arms of the bracket 57 are slotted as indicated at 86 to allow the unit 36 to be removed from and replaced onto the bracket 57 when the drive belt 62 is removed from the drive pulley 64.

Figure 9:
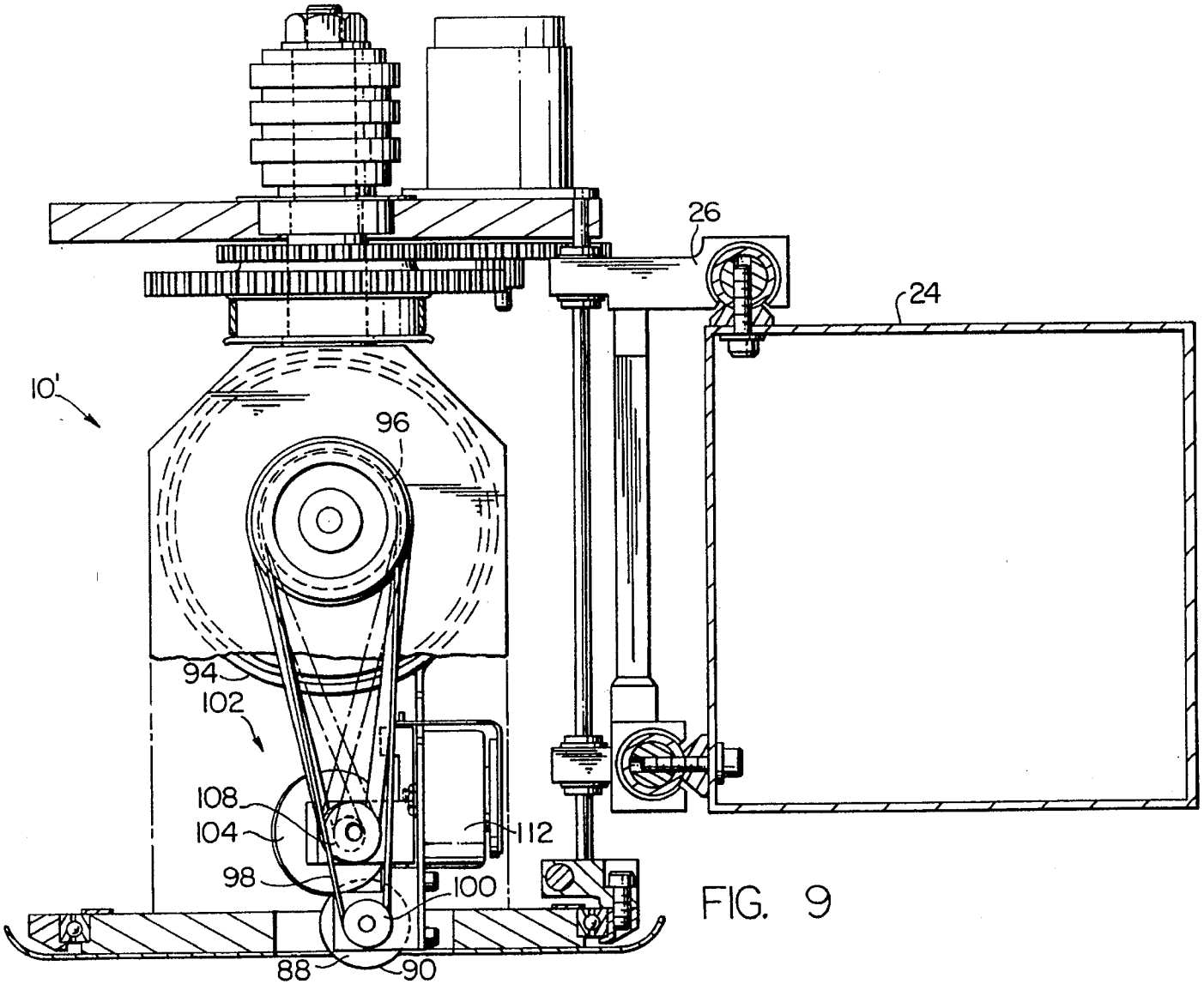
FIG. 9 is a front view, partly in elevation and partly in section of an alternative cutting head which may be used in the machine of FIG. 1.
Figure 10:
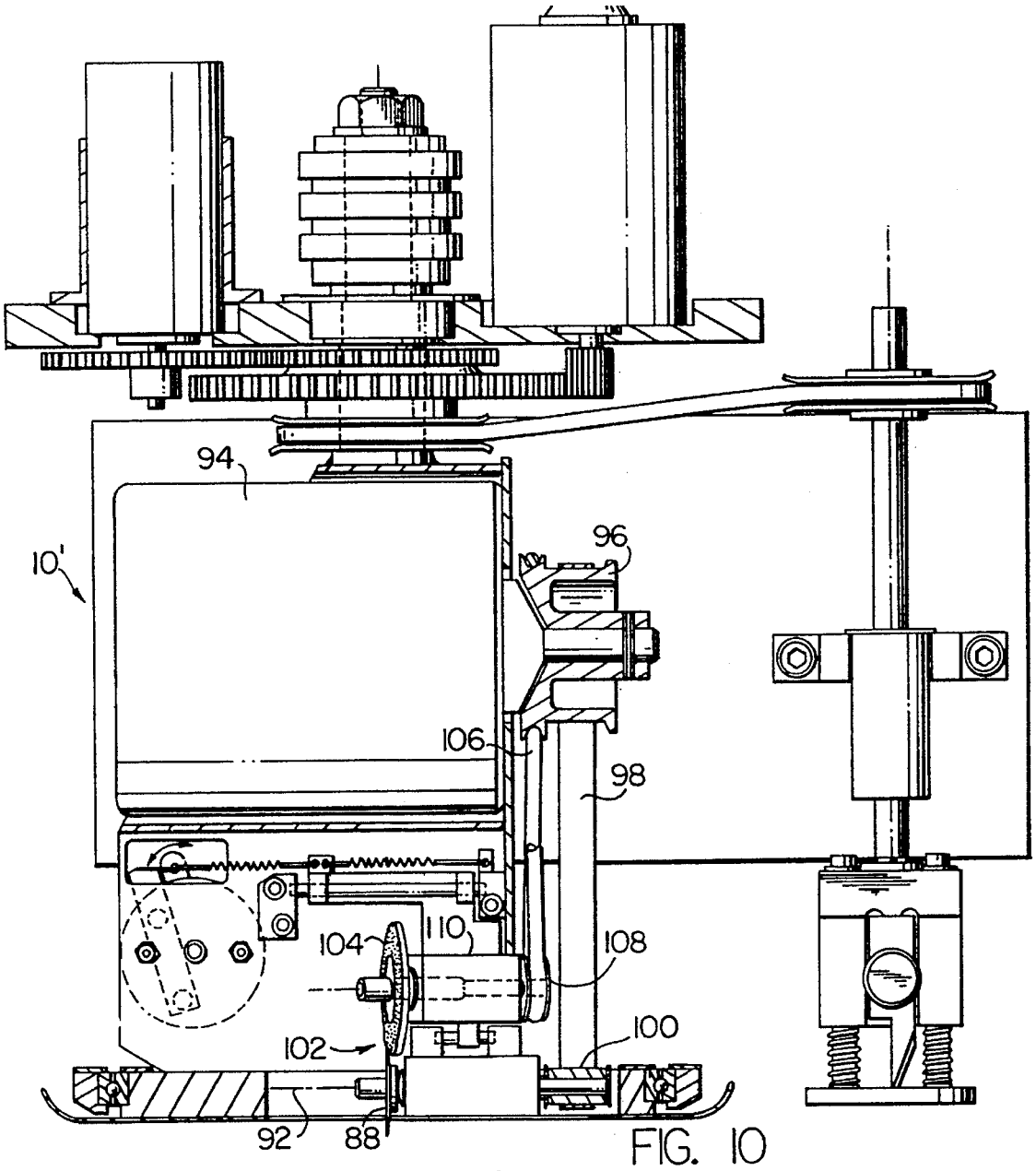
FIG. 10 is a side view of the cutting head of FIG. 9.
Figure 11:
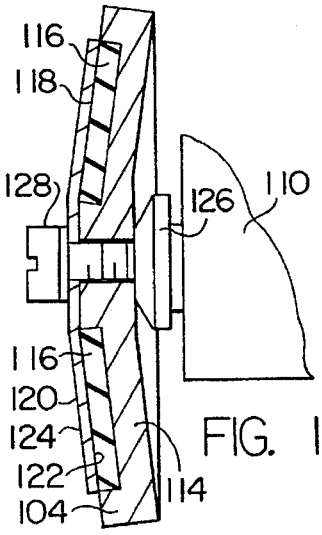
FIG. 11 is a vertical sectional view taken through the sharpening unit of the cutting head of FIG. 9.

The shape of the knife and of the sharpening unit used with the knife may vary widely without departing from the invention, and as an example such different shapes of the knife and sharpening unit are shown in an alternative form of cutting head 10' shown by FIGS. 9, 10 and 11. Referring to these figures the illustrated head 10' may be substituted for the head 10 of FIG. 1 and, except for its cutting knife and sharpening unit, is or may be essentially identical to the cutting head shown in U.S. Pat. No. 4,643,061 to which reference may be made for a better understanding of its constructional details. For the present purposes, it is sufficient to note that the cutting head 10' includes a generally disc shaped, circular cutting knife 88 having a circular cutting edge 90 defined by its outer periphery. The knife is rotated in a cutting motion about its horizontal central axis 92 by a drive motor 94, drive pulley 96, drive belt 98 and driven pulley 100. Associated with the knife 88 is a sharpening mechanism, illustrated generally at 102, having a rotatably driven sharpening unit 104, the sharpening unit 104 being also driven by the motor 94 and drive pulley 96 through a drive belt 106 and driven pulley 108. The sharpening unit 104 is carried by a slide block 110 movable between a position at which the sharpening unit is out of engagement with the knife 88 and another position at which the sharpening unit engages the knife 88, such movement of the block being effected by a rotary solenoid 112.

As seen in FIG. 11, the sharpening unit 104 includes a base member 114 of metal or other rigid material having a generally conical shape and carrying a frusto-conically shaped resilient backup member 116 having an outwardly facing frusto-conical support surface 118. Received on the base member 114 and overlying the resilient backup member 116 is a flexible grit carrier member 120 also of generally frusto-conical shape and having an inner face 122 engaging the outer face 118 of the resilient backup member 116 and an outer face 124 carrying particles of abrasive grit. The carrier member 120 is made of a piece of flexible material such as paper, fabric or the like having its outer face carrying the abrasive grit particles and to which face the particles are fastened by adhesive or the like. Again, the abrasive particles are preferably made of ceramic aluminum oxide and preferably are of approximately grit size 80. The grit carrying member is held to the base member 114 by a screw 128 threaded into the drive shaft 126 for the sharpening unit to allow easy replacement of the grit carrier member 120 by a new one after it has become worn.

As mentioned, the knife of the present invention requires sharpenings on a much less frequent basis than the knives previously used in machines for automatically cutting cloth and similar sheet materials. As an example, in an application where previous knives required sharpening after approximately every thirty inches of cut, knives made in accordance with the present invention were found to be able to cut satisfactorily for 60 to 600 inches before requiring resharpening.

We claim:

1. A knife and associated sharpener for use in a machine for automatically cutting sheet materials wherein the material to be cut is spread on a supporting surface and the knife moved along lines of cut extending parallel to said supporting surface and driven in a cutting motion relative to said supporting surface, said knife having a cutting portion defining a cutting edge which engages and cuts the sheet material spread on said supporting surface as said knife is moved along said lines of cut and is driven in said cutting motion, at least said cutting portion of said knife being formed of a high-alloy tool steel having an HRC hardness of between 55 to 64 and having at least 20% of its weight made up of alloying elements selected from the class consisting of carbon, molybedenum, vanadium, manganese, tungsten, silicon and chromium, and said sharpener having a rotatably driven sharpening unit selectively movable into and out of sharpening contact with said knife, said sharpening unit having a flexible grit carrier member having front and rear parallel faces and carrying abrasive grit particles on said front face, and a supporting holder for said flexible grit carrier member, said supporting holder including a base body of relatively rigid material and a backup member for said flexible grit carrier member carried by said base body, said backup member being made of a resilient material and having a face engaging said flexible grit carrier member so that said flexible grit carrier member is resiliently yielding during a sharpening operation in the direction perpendicular to said front face and in the direction toward said resilient backup member, said knife being an elongated one having a longitudinal axis and having a sharp cutting edge extending along a line essentially parallel to said longitudinal axis, said sharpening unit being one wherein said base body is of substantially cylindrical form, said backup member being an annular resilient member carried by said base body, and said flexible grit carrier member being an annular sleeve surrounding and supported on said annular backup member.

2. A knife and associated sharpener for use in a machine for automatically cutting sheet materials wherein the material to be cut is spread on a supporting surface and the knife moved along lines of cut extending parallel to said supporting surface and driven in a cutting motion relative to said supporting surface, said knife having a cutting portion defining a cutting edge which engages and cuts the sheet material spread on said supporting surface as said knife is moved along said lines of cut and is driven in said cutting motion, at least said cutting portion of said knife being formed of a high-alloy tool steel having an HRC hardness of between 55 to 64 and having at least 20% of its weight made up of alloying elements selected from the class consisting of carbon, molybedenum, vanadium, manganese, tungsten, silicon and chromium, and said sharpener having a rotatably driven sharpening unit selectively movable into and out of sharpening contact with said knife, said sharpening unit having a flexible grit carrier member having front and rear parallel faces and carrying abrasive grit particles on said front face, and a supporting holder for said flexible grit carrier member, said supporting holder including a base body of relatively rigid material and a backup member for said flexible grit carrier member carried by said base body, said backup member being made of a resilient material and having a face engaging said flexible grit carrier member so that said flexible grit carrier member is resiliently yieldable during a sharpening operation in the direction perpendicular to said front face and in the direction toward said resilient backup member, said knife being a circular one having a circular sharp cutting edge extending along its periphery, said sharpening unit being one wherein said base body is one having a generally conical portion, said backup member being an annular member supported on said conical portion of said base body and having a frusto-conical support surface, and said flexible grit carrier member being of frusto-conical shape with said rear face thereof engaging said frusto-conical support surface of said resilient backup member.

* * * * *